US005660070A

United States Patent [19]

Muryn et al.

[11] Patent Number: 5,660,070

[45] Date of Patent: Aug. 26, 1997

[54] COLD ROLLING MILL WITH TENSION BRIDLE

[75] Inventors: Stephen Muryn, Allegheny County, Pa.; D. Leonard Wise, Guilford County, N.C.

[73] Assignee: Carolina Steel Corporation, Greensboro, N.C.

[21] Appl. No.: 616,556

[22] Filed: Mar. 18, 1996

[51] Int. Cl.[6] ..... B21B 39/08; B21B 41/06

[52] U.S. Cl. ..... 72/229; 72/205

[58] Field of Search ..... 72/160, 161, 205, 72/229, 365.2, 366.2

[56] References Cited

U.S. PATENT DOCUMENTS 3,459,019 8/1969 Stone ..... 72/205

3,580,033 5/1971 Gay ..... 72/205

4,134,283 1/1979 Noe ..... 72/205

*Primary Examiner*—Lowell A. Larson

*Assistant Examiner*—Rodney A. Butler

*Attorney, Agent, or Firm*—Buchanan Ingersoll, P.C.

[57] ABSTRACT

Tension bridles for a cold rolling reducing mill are provided. The reducing mill reduces the thickness of a metal strip passing through the reducing mill. The tension bridles create tension on the metal strip between the bridle and the first reducing stand to receive the metal strip and between the final reducing stand and the exit bridle so that a greater reduction can be made in the thickness of the metal strip in the first reducing stand and in the final reducing stand than is ordinarily possible. When the reducing mill is a reversible mill, a tension bridle positioned at each end of the mill enhances the reducing qualities of the mill and also enhances the quality of the metal strip being coiled after it passes through the mill.

14 Claims, 2 Drawing Sheets

COLD ROLLING MILL WITH TENSION BRIDLE

BACKGROUND OF THE INVENTION

1. Field of the Invention

This invention relates to tension bridles for a cold rolling mill that reduces the thickness of a metal strip as the metal strip is passed through the rolling mill. The tension bridles create increased tension in the strip at the reducing stand following the bridle so that an increased reduction in thickness of the metal strip can be obtained than would ordinarily be the case without the tension bridle. The invention is also applicable to reversing cold rolling mills whereby a tension bridle is positioned at each end of the reversing mill. By placing a tension bridle after the final reducing stand, increased tension can be placed on the strip to cause an increased reduction in thickness of the strip in the final stand. The higher tension on the final reducing stand will improve the strip gauge and shape without any detrimental effect on the end product. The use of the exit bridle will also reduce tension on the coiler reels which reduces coil quality problems.

2. Description of the Prior Art

Cold rolling mills for reducing the thickness of metal strip products are well known. Cold rolling mills are utilized in many industries such as the rolling of steel, aluminum, and other nonferrous metals. In the typical steel cold rolling mill, a series of reducing stands containing reducing rolls are utilized to gradually reduce the initial thickness of the strip steel entering the first stand by passing the strip steel between opposed rolls which reduce its thickness.

Cold rolling mills that are reversible are also well known in the art and in such mills, a strip of metal is passed in one direction through one or more reducing stands and the strip is coiled after the first pass through the mill. The strip is then reversed in direction and passes through the stands a second time to achieve further reduction of the thickness of the metal strip. Upon passing through the reducing stands a second time, the metal strip is again coiled. The metal strip can be passed through the reducing stands three, four or more times to achieve the level of reduction desired in the finished product.

A tension bridle of the type disclosed in this Specification has not been used to increase the tension on the reducing stands of a cold rolling mill at both the entry end and the exit end of the mill. The tension bridle of the present invention, by increasing the tension of the strip between the bridle and the reducing stand allows a significant increase in reduction in thickness to take place within each reducing stand that the bridle operates on than would be possible without the tension bridle.

SUMMARY OF THE INVENTION

In accordance with the present invention, there is provided a cold rolling mill for reducing the thickness of a metal strip by passing the metal strip through a plurality of reducing stands containing opposing rolls that reduce the thickness of the metal strip and the mill is improved by providing a tension bridle having two adjacent rolls around which the metal strip is threaded. The entry tension bridle is located before the entry end of the first reducing stand entered by the metal strip so that the metal strip passes through the tension bridle before entering the first reducing stand. The exit tension bridle is located after the last stand and before the strip enters the take-up reel.

Further in accordance with the present invention, there is provided a reversing cold rolling mill for reducing the thickness of a metal strip by passing the metal strip in forward and reverse directions through reducing stands. The reversing cold rolling mill includes a first reducing stand having two reducing rolls and two back-up rolls whereby the metal strip passes between the reducing rolls to be reduced in thickness. A final reducing stand having two reducing rolls and two back-up rolls is also provided. A first tension bridle which includes two adjacent rolls around which the metal strip is threaded is located between the initial starting point of the metal strip into the mill and the entry end of the first reducing stand when the metal strip is traveling in the forward direction. A second tension bridle including two adjacent rolls around which the metal strip is threaded is also provided. The second tension bridle is located between the exit end of the final reducing stand and the take-up reel for the metal strip when the metal strip is traveling in the forward direction.

Accordingly, an object of the present invention is to provide an improved cold rolling mill.

Another object of the present invention is to provide a cold rolling mill which permits a greater initial reduction at the first reducing stand in each direction of travel by use of a tension bridle preceding the first reducing stand.

These and other objects of the present invention will become apparent as the invention is more completely disclosed and described in the following specification, the accompanying drawings and the appended claims.

DESCRIPTION OF THE PREFERRED EMBODIMENT

Figure 1:
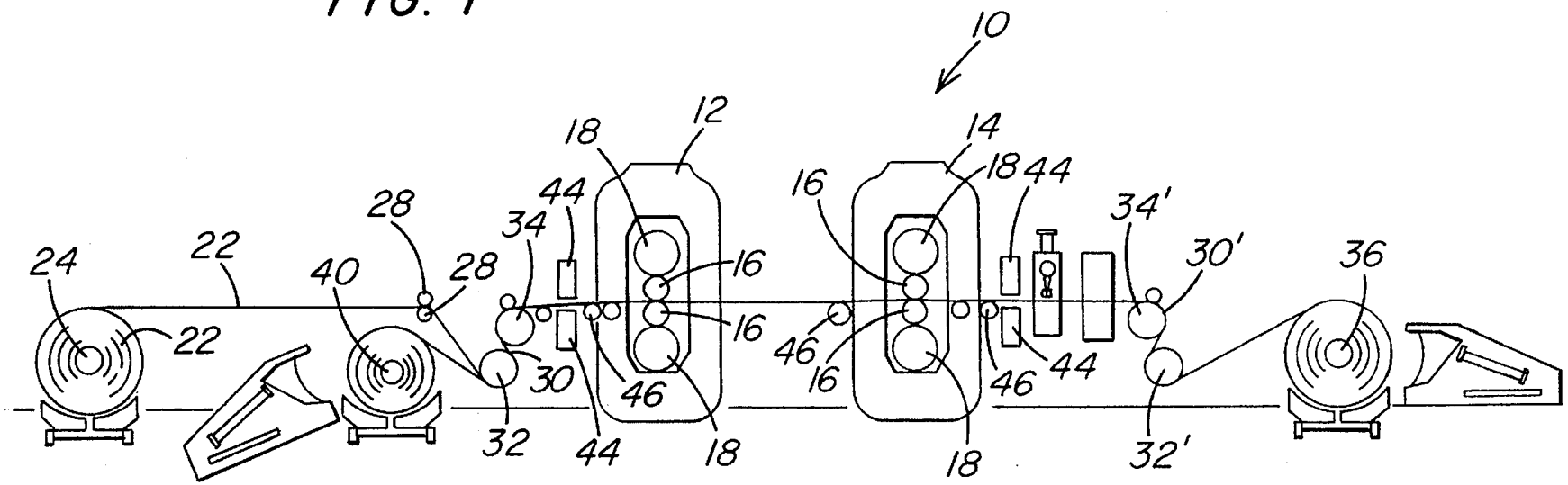
FIG. 1 is a schematic elevational view of a cold rolling mill in accordance with the present invention.
Figure 2:
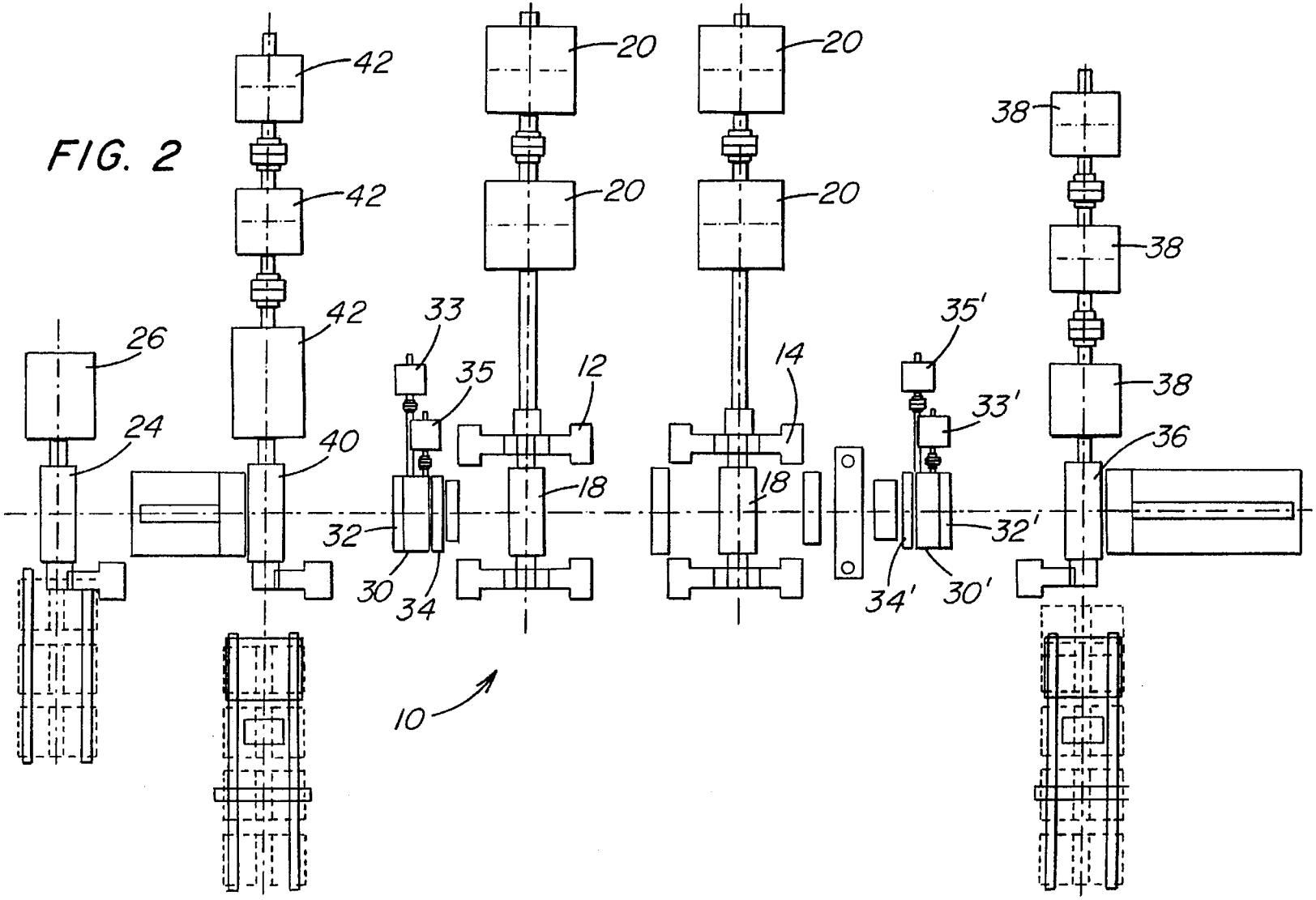
FIG. 2 is a plan view of the mill of FIG. 1 illustrating the relative position of some of the components of the mill.

Referring to the drawings, there is shown a reversing cold rolling mill 10 having a first reducing stand 12 and a final reducing stand 14. In this description, the mill of the present invention will be described as a mill for cold rolling carbon steel strip. It will be appreciated that a similar mill with minor modifications can be utilized for rolling aluminum, other non-ferrous metals, and specialty steel.

Each of the reducing stands 12 and 14 have reducing rolls 16 and back-up rolls 18 that contact the reducing rolls 16. The back-up rolls 18 are motor driven by mill motors 20 in conventional fashion. The reducing stands 12 and 14 are commonly referred to as 4-high reducing stands and the back-up rolls may conventionally be the driven rolls in such 4-high reducing stands.

The carbon steel strip 22 passes between reducing rolls 16 in each of the stands 12 and 14 to reduce the thickness of the strip as pressure is applied to the strip by the reducing rolls 16 of each stand being biased toward each other. The carbon steel strip 22 conventionally arrives at the cold rolling mill in coil form. The coil of steel strip 22 is placed upon a pay-out reel 24 which feeds the steel strip to the mill. Pay-out reel 24 is driven by a motor 26.

As shown in FIG. 1, guide rollers 28 guide the steel strip 22 to a first tension bridle 30 that has a lower bridle roll 32 and an upper bridle roll 34 each of which is driven by motors 33 and 35, respectively. The lower bridle roll 32 is in contact with the upper surface of steel strip 22 and the upper bridle roll 34 is in contact with the lower surface of steel strip 22. The steel strip 22 is threaded around rolls 32 and 34 and then is directed into the first reducing stand 12. From first reducing stand 12, the steel strip 22 proceeds into the final reducing stand 14 and then through a second tension bridle 30' which has a lower bridle roll 32' that contacts the upper surface of steel strip 22 and an upper bridle roll 34' which contacts the lower surface of steel strip 22 each of which is driven by motors 33' and 35', respectively. After passing through the second tension bridle 30', the steel strip is coiled on a take-up reel 36.

After the entire steel strip 22 has passed through the reducing stands 12 and 14, the direction of the mill is reversed and the steel strip passes in a reverse direction through second tension bridle 30', through the final reducing stand 14, through the first reducing stand 12, through the first tension bridle 30, and back to a take-up reel 40 which coils the steel strip 22. The take-up reel 40 is driven by motors 42 and the take-up reel 36 is driven by motors 38.

If further reduction is desired, the steel strip 22 can again be passed through the reversing cold rolling mill 10 by passing the strip through first tension bridle 30, the reducing stands 12 and 14, the second tension bridle 30', and coiling the steel strip on take-up reel 36. In conventional fashion, the reversing cold rolling mill 10 may contain x-ray units 44 and tensiometer rolls 46 to enhance quality control of the strip.

It will be appreciated that when the mill is being operated so that the strip is moving from left to right as viewed in FIG. 1, the tension bridle 30 is driven by motors 33 and 35 to operate at a slower strip speed than the strip speed of reducing stand 12 to create tension on the strip between bridle 30 and reducing stand 12. In a like manner, reducing stand 14 operates at a greater strip speed than reducing stand 12 and tension bridle 30' operates at a greater strip speed than reducing stand 14 thereby creating tension throughout the rolling process.

When the direction of the strip is reversed, bridle 30' operates at a slower strip speed than stand 14. In a like manner, stand 12 operates at a greater strip speed than stand 14 and tension bridle 30 operates at a greater strip speed than stand 12.

Several advantages are gained by utilizing the tension bridles 30 and 30' in the reversing cold rolling mill 10. The maximum initial reduction in strip thickness in the first stand of a rolling mill is conventionally 20% to 25% of the total reduction desired. By utilizing the tension bridle 30, the initial reduction in the first reducing stand 12 of the present invention can be as high as 35% to 40% of the total desired reduction. This higher reduction occurs because the tension in the strip 22 between the first bridle 30 and the reducing rolls 16 is substantially increased over the tension that can be provided in the strip when it is played off the pay-out reel 24 and enters the first reducing stand 12 directly. Similarly, when the strip enters exit bridle 30', the tension between exist bridle 30' and the final reducing stand 14 is increased.

In like manner, when the mill 10 is reversed, the second tension bridle 30' increases the tension between bridle 30' and stand 14 so that a greater reduction in size may occur. In a steel cold rolling mill of the present invention with two reducing stands and two tension bridles 30 and 30', three passes of the strip 22 through the mill enable a reduction in strip thickness from an initial thickness of 0.090 inches to a final strip thickness of 0.008 inches.

The tension bridles 30 and 30' offer a further advantage in that they precede the take-up reels 36 and 40 in the direction of movement of the steel strip 22. Accordingly, the take-up reel 36, as an example, need not produce high tension at the reel 36 since the tension is produced at the tension bridle 30'. The rotative force on reel 36 may thereby be reduced so that the layers of steel strip 22 coiled onto take-up reel 36 will not be forced against one another to the point where they stick to each other during a subsequent batch annealing process or the like. Likewise, the yield of the mill will increase since, historically, the first two or three wraps on the take-up reel are so tightly wrapped that they must be scrapped. With the lesser force required to operate the take-up reels 36 and 40, the amount of scrap is greatly reduced thereby increasing the yield of the mill.

Either one or both of the reducing stands 12 and 14 may be equipped with automatic roll changing functions. In this manner, on the final pass of the steel strip 22 through the reducing stands, the last reducing stand to operate on the steel strip may have textured rolls substituted for the reducing rolls 16 so that a textured surface may be imparted to the steel strip 22 to satisfy customer demands.

Because the bridles 30 and 30' maintain tension through all the stands of the mill, them will be tension on the strip during coil transfer so that the shape and gauge of the strip will remain constant as in a continuous cold rolling mill.

According to the provisions of the patent statutes, we have explained the principle, preferred construction and mode of operation of our invention and have illustrated and described what we now consider to represent its best embodiment. However, it should be understood that, within the scope of the appended claims, the invention may be practiced otherwise than as specifically illustrated and described.

We claim:

1. In a reversing cold rolling mill for reducing the thickness of a metal strip by passing said metal strip in each direction through a reducing stand, and onto take-up reels at either side of the reducing stand, said reducing stand containing opposing rolls that reduce the thickness of said metal strip, the improvement comprising:

a first tension bridle comprising two adjacent rolls around which said metal strip is threaded, said first tension bridle being located before the entry end of said reducing stand entered by said metal strip when said metal strip travels in a first direction through said mill;

a second tension bridle comprising two adjacent rolls around which said metal strip is threaded, said second tension bridle being located before the entry end of said reducing stand entered by said metal strip when said metal strip travels in a reverse direction opposite to said first direction through said mill;

said first and second tension bridles being directly in line with said take-up reels so that said strip passes directly from said bridle at the exit side of said reducing stand to said take-up reel.

2. The improvement of claim 1 wherein said first tension bridle and said second tension bridle each have roll contact with said metal strip on each flat surface of said metal strip.

3. The improvement of claim 1 wherein said rolls of said first and second tension bridles are motor driven.

4. A reversing cold rolling mill for reducing the thickness of a metal strip by passing said metal strip in forward and reverse directions through reducing stands, and onto take-up reels at either side of the reducing stands, said reversing cold rolling mill comprising:

a first reducing stand having two reducing rolls and two back-up rolls whereby said metal strip passes between said reducing rolls to be reduced in thickness;

a final reducing stand having two reducing rolls and two back-up rolls whereby said metal strip passes between said reducing rolls to be reduced in thickness;

a first tension bridle comprising two adjacent rolls around which said metal strip is threaded, said first tension bridle being located between the initial starting point of said metal strip entering said mill and the entry end of said first reducing stand when said metal strip is traveling in said forward direction;

a second tension bridle comprising two adjacent rolls around which said metal strip is threaded, said second tension bridle being located between the exit end of said final reducing stand and said take-up reel for said metal strip when said metal strip is traveling in said forward direction;

said first and second tension bridles being directly in line with said take-up reels so that said strip passes directly from said bridle at the exit side of said reducing stand to said take-up reel.

5. The reversing cold rolling mill of claim 4 wherein said first tension bridle and said second tension bridle each have roll contact with said metal strip on each flat surface of said metal strip.

6. The reversing cold rolling mill of claim 4 wherein the back-up rolls of said first and final reducing stands are motor driven rolls.

7. The reversing cold rolling mill of claim 4 wherein the total number of said reducing stands is two.

8. The revering cold rolling mill of claim 4 wherein said rolls of said first and second tension bridles are motor driven.

9. The reversing cold rolling mill of claim 7 wherein said metal strip undergoes four separate reductions when said metal strip is passed through said mill once in each direction.

10. The reversing cold rolling mill of claim 7 wherein said metal strip undergoes six separate reductions when said metal strip is passed through said mill in a forward direction, is thereafter reversed and is passed through said mill in a reverse direction and is thereafter passed through said mill a second time in the forward direction.

11. The reversing cold rolling mill of claim 7 wherein one of said reducing stands has automatically replaceable reducing rolls so that texturing rolls may be positioned in said reducing stands on the last pass of said metal strip through said mill to provide a textured surface of said metal strip.

12. A reversing cold rolling mill for reducing the thickness of a metal strip by passing said metal strip in forward and reverse directions through a reducing stand and onto take-up reels at either side of the reducing stand, said reversing cold rolling mill comprising:

a reducing stand having two reducing rolls whereby said metal strip passes between said reducing rolls to be reduced in thickness;

a first tension bridle comprising two adjacent rolls around which said metal strip is threaded, said first tension bridle being located between the initial starting point of said metal strip entering said mill and the entry end of said reducing stand when said metal strip is traveling in said forward direction;

a second tension bridle comprising two adjacent rolls around which said metal strip is threaded, said second tension bridle being located between the exit end of said stand and the take-up reel for said metal strip when said metal strip is traveling in said forward direction;

said first and second tension bridles being directly in line with said take-up reels so that said strip passes directly from said bridle as it exits said reducing stand to said take-up reel.

13. The reversing cold rolling mill of claim 12 wherein said first tension bridle and said second tension bridle each have roll contact with said metal strip on each flat surface of said metal strip.

14. The reversing cold rolling mill of claim 12 wherein said rolls of said first and second tension bridles are motor driven.

* * * * *

UNITED STATES PATENT AND TRADEMARK OFFICE

CERTIFICATE OF CORRECTION

PATENT NO. : 5,660,070

DATED : August 26, 1997

INVENTOR(S) : STEPHEN MURYN, D. LEONARD WISE

It is certified that error appears in the above-indentified patent and that said Letters Patent is hereby corrected as shown below:

Column 5, claim 8, line 26, change "revering" to —reversing—.

Signed and Sealed this

Twenty-first Day of October 1997

*Attest:*

*Attesting Officer*

BRUCE LEHMAN

*Commissioner of Patents and Trademarks*